US009230771B2

(12) United States Patent
Raggio

(10) Patent No.: US 9,230,771 B2
(45) Date of Patent: Jan. 5, 2016

(54) METHOD OF MANUFACTURING AN ELECTRODELESS LAMP ENVELOPE

(71) Applicant: Rayotek Scientific, Inc., San Diego, CA (US)

(72) Inventor: William Raggio, Del Mar, CA (US)

(73) Assignee: Rayotek Scientific, Inc., San Diego, CA (US)

( * ) Notice: Subject to any disclaimer, the term of this patent is extended or adjusted under 35 U.S.C. 154(b) by 0 days.

(21) Appl. No.: 14/557,926

(22) Filed: Dec. 2, 2014

(65) Prior Publication Data

US 2015/0318137 A1 Nov. 5, 2015

Related U.S. Application Data

(60) Provisional application No. 61/988,431, filed on May 5, 2014.

(51) Int. Cl.
*H01J 9/26* (2006.01)
*H01J 9/40* (2006.01)
*H01J 9/24* (2006.01)

(52) U.S. Cl.
CPC *H01J 9/266* (2013.01); *H01J 9/247* (2013.01)

(58) Field of Classification Search
CPC ..... H01J 65/00–65/08; H01J 9/26–9/268; H01J 9/40; C03B 23/20–23/217
See application file for complete search history.

(56) References Cited

U.S. PATENT DOCUMENTS 5,621,275 A 4/1997 Wei et al.
5,727,975 A * 3/1998 Wei ..... H01J 9/40 455/22
5,818,167 A 10/1998 Lapatovich et al.
6,955,579 B2 10/2005 Hecker et al.
7,215,081 B2 5/2007 Bewlay et al.
7,438,621 B2 * 10/2008 Kebbede ..... H01J 63/363 313/318.01
7,443,091 B2 10/2008 Bewlay et al.
7,892,061 B2 2/2011 Bewlay et al.
2002/0017876 A1 2/2002 Herter
2002/0070668 A1 6/2002 Eastlund et al.
2002/0105274 A1 * 8/2002 Pothoven ..... C04B 35/10 313/634
2007/0075644 A1 * 4/2007 Peuchert ..... C03C 27/044 313/637
2008/0227359 A1 * 9/2008 Guthrie ..... H01J 9/247 445/42
2012/0067858 A1 3/2012 Kangastupa et al.
2013/0040529 A1 * 2/2013 Guthrie ..... H01J 65/00 445/40
2013/0070428 A1 3/2013 Kangastupa et al.
2013/0112650 A1 5/2013 Karam et al.

FOREIGN PATENT DOCUMENTS

JP 54048981 A * 4/1979

* cited by examiner

*Primary Examiner* — Mariceli Santiago
(74) *Attorney, Agent, or Firm* — Thompson Coburn LLP

(57) ABSTRACT

A method of forming a hermetically sealed electrodless lamp envelope includes: (1) forming an envelope blank; (2) depositing a gas and light generating expedient material in an interior of the envelope blank; (3) arranging a window on an open end of the envelope blank; and (4) using an ultra-short pulse laser system to locally heat the axial end of the envelope blank and the window to seal the window on the envelope blank without degrading the contents deposited in an interior of the envelope or damaging or cracking the envelope blank and/or window.

24 Claims, 6 Drawing Sheets

METHOD OF MANUFACTURING AN ELECTRODELESS LAMP ENVELOPE

RELATED APPLICATION DATA

This application claims the benefit of provisional patent application Ser. No. 61/988,431, filed on May 5, 2014, currently pending, the disclosure of which is incorporated by reference herein.

BACKGROUND AND SUMMARY

This disclosure is directed to an electrodeless lamp envelope although it could be applied to other lamp and ampule configurations. In an electrodeless lamp system, the power required to generate the light from the electrodeless lamp envelope is transferred from outside the lamp envelope to the gas inside the lamp envelope via an electric or magnetic field. An interior of the envelope may be filled with a gas capable of producing a desired emission of light energy, such as neon, xenon, or argon. There may also be trace materials added to the interior of the envelope such as mercury or metal halides to help ignite the gas of the lamp and create a desired emission of light energy. In particular, the disclosure is related to methods of hermetically sealing the envelope. In one aspect, the disclosure is related to methods of hermetically sealing an envelope formed from sapphire. This disclosure is also related to deposition of dielectric coatings on surfaces of the envelope and forming desired geometric surfaces on portions of the exterior of the envelope for focusing the light energy emitted from the lamp and/or to generate other desired optics.

DETAILED DESCRIPTION OF THE PREFERRED EMBODIMENT

Figure 1A:
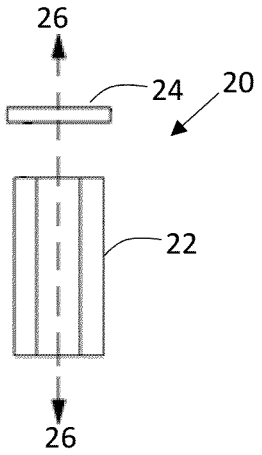
FIGS. 1A-1E show a process of forming an envelope blank.
Figure 1B:
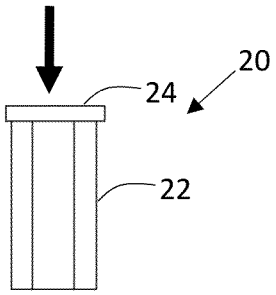
Figure 1C:
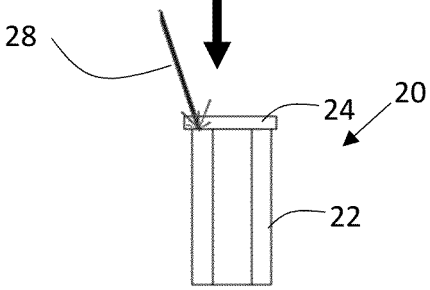
Figures 1D, 1E:
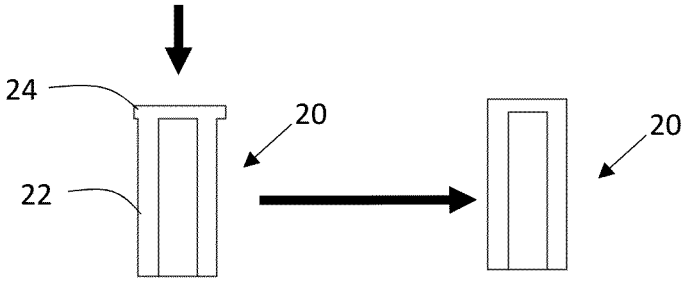

Although the terms "top," "bottom," "base," "cylinder," and "end" are used in the discussion that follows, the use is not intended to be limiting in any sense. Rather, the use is merely for illustrative purposes in describing certain embodiments as they appear in the drawings. The embodiments may have other orientations and shapes.

FIGS. 1A-1E show the process of forming an envelope blank. The envelope blank 20 comprises a lamp tube 22 and a base end window 24. The base end window 24 and lamp tube 22 may be any size and shape. The base end window 24 and lamp tube 22 may be formed from a sapphire material. The base end window 24 may be fitted at an axial end of the lamp tube 22. Preferably, the lamp tube 22 and the base end window 24 have their crystal orientation matched to provide a strong seal for the base end window on the axial end of the lamp tube.

Figure 13:
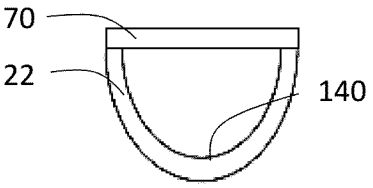
Figure 14:
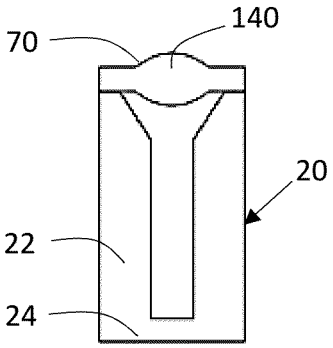
Figure 16:
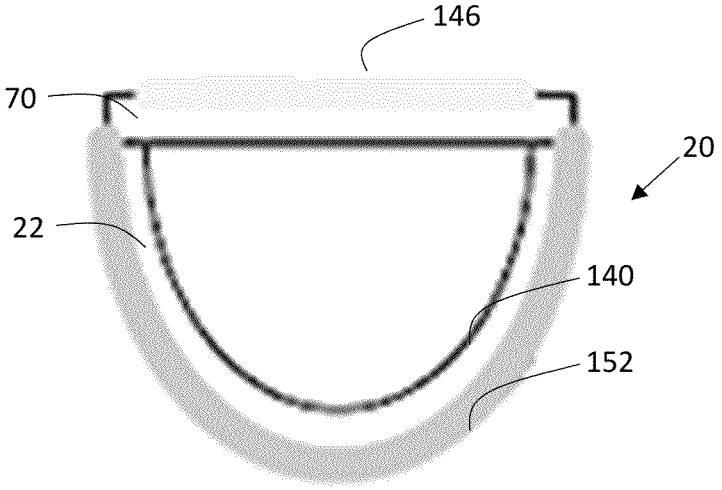
FIG. 16 is an alternate embodiment of an envelope with a dielectric coating deposited on a lens of the envelope and a parabolic outer surface of the envelope.

The preferred orientation for aligning the base end window with the lamp tube may be along the axis 26 as shown in FIG. 1. The mating faces of the base end window 24 and the axial end of the lamp tube 22 may be both perpendicular to the axis 26. The base end window and axial end of the lamp tube may be polished flat. The base end window may be placed on the axial end of the lamp tube allowing the mating surfaces of the base end window and the tube to be in contact (FIG. 1B). Using localized heating 28 from an ultra-short pulse laser system, which is capable of heating on a microscopic level, as described below, the axial end area of the tube and base end window may be heated, sealing the tube and base end window together to form an envelope blank 20 (FIG. 1C). The mating surfaces of the lamp tube and the base end window may be fused together with the localized heating to form a monolithic structure between the base end window and the tube, thereby forming the envelope blank for later processing as described below. The method has been proven effective for a base end window and lamp tube made from sapphire. Materials other than sapphire may also be sealed. After the envelope blank 20 is formed, the envelope blank may be finished into a desired form to allow it to be further processed as will be described below in greater detail. As shown in FIGS. 1D-1E, excess end material may trimmed and removed from the base end window 24 to allow the end of the envelope blank 20 to have a slim profile which will allow the envelope blank to be received in fixturing for further processing as will be described below. While FIGS. 1A-1E show a generally cylindrically shaped envelop blank, the envelope blank may be other shapes, for instance, parabolic as shown in FIGS. 13 and 16.

The ultra-short pulse laser system may be a picosecond pulse laser system, for instance, one developed by Primoceler. The laser may be of the type disclosed in U.S. Pat. App. Pub. No. 2012/0067858 and U.S. Pat. App. Pub. No. 2013/0070428, the disclosures both of which are incorporated herein by reference. The laser may also be a femtosecond pulse laser system or an attosecond pulse laser system. The laser is capable of heating the materials on a microscopic level in selected localized areas and thus not heating other areas of the envelope or its contents. The laser, and the lamp tube and bottom end window, may also be configured as disclosed in US Pat. App. Pub. No. 2013/0112650, the disclosure of which is incorporated by reference. A thin heat absorbing material may be applied on one of the sealing faces as disclosed in U.S. Pat. App. Pub. No. US 2013/0112650 to enhance the localized heating and thus the sealing process to form the envelope blank.

In the alternative, depending upon the application, the envelope blank may be formed by conventional heating means. For instance, the base end window and lamp tube may be placed in contact and heated in a high temperature furnace to form the envelope blank. Such a process is disclosed by example in U.S. Pat. No. 5,621,275, the disclosure of which is incorporated herein by reference. This method may be used when the base end window does not contain a lens or coating prior to sealing with the lamp tube, and general heating may be acceptable when forming the envelope blank.

FIGS. 2 through 8 show an exemplary process and tooling that may be used for finishing the envelope blank 20 to a hermetically sealed envelope. The tooling comprises a high purity pressure chamber 30. The pressure chamber 30 comprises a fixture body 32 with a base 34 and a hollow interior 36 that closely matches the exterior shape of the lamp tube, for instance, a cylindrical shape with a hollow interior diameter of generally corresponding to the outer diameter of the envelope blank. The fixture body base 34 is disposed at an axial end of the cylindrical interior with an opening 38 into the hollow interior 36 opposite the base. The opening 38 provides access to the hollow interior 36 of the fixture body 32. The fixture body 32 may have a port 40 that connects to a three-way valve 42. The three-way valve 42 may be configured to align to a gas source 44 to pressurize the pressure chamber, or a vacuum 46 to evacuate the pressure chamber, as will be described below in greater detail. The open axial end 38 of the fixture body 32 may have annular seals 48 (e.g., o-ring type gaskets). An outer surface 50 of the fixture body 32 adjacent to the open axial end 38 may be threaded. The fixture body base 34 may have a plunger 52 extending therethrough into the hollow interior 36 of the fixture body 32. A shaft of the plunger 52 may be configured for sliding motion with the fixture body base 34 through a vacuum tight seal 54. A coil spring 56 may be disposed on the plunger end in the hollow interior of the fixture body.

The pressure chamber 30 may comprise a compression seal cap 60 that is configured to fit over the open axial end 38 of the fixture body 32. The compression seal cap 60 may have an inner cylindrical wall 62 with internal threads that match the threading on the outer diameter surface 50 of the fixture body 32, allowing the cap to be threaded around the fixture body to seal the pressure chamber. Other means may be provided to releasably connect the seal cap to the fixture body, i.e., mechanical fasteners, clamps, quick release connectors. The seal cap 60 may have an internal shoulder with annular seals 64 (e.g., o-ring type gaskets) and an access opening 66 on an axial end of the seal cap. The pressure chamber 30 may be portable to allow it to be inserted into and removed from an atmosphere controlled glove box.

Figure 2:
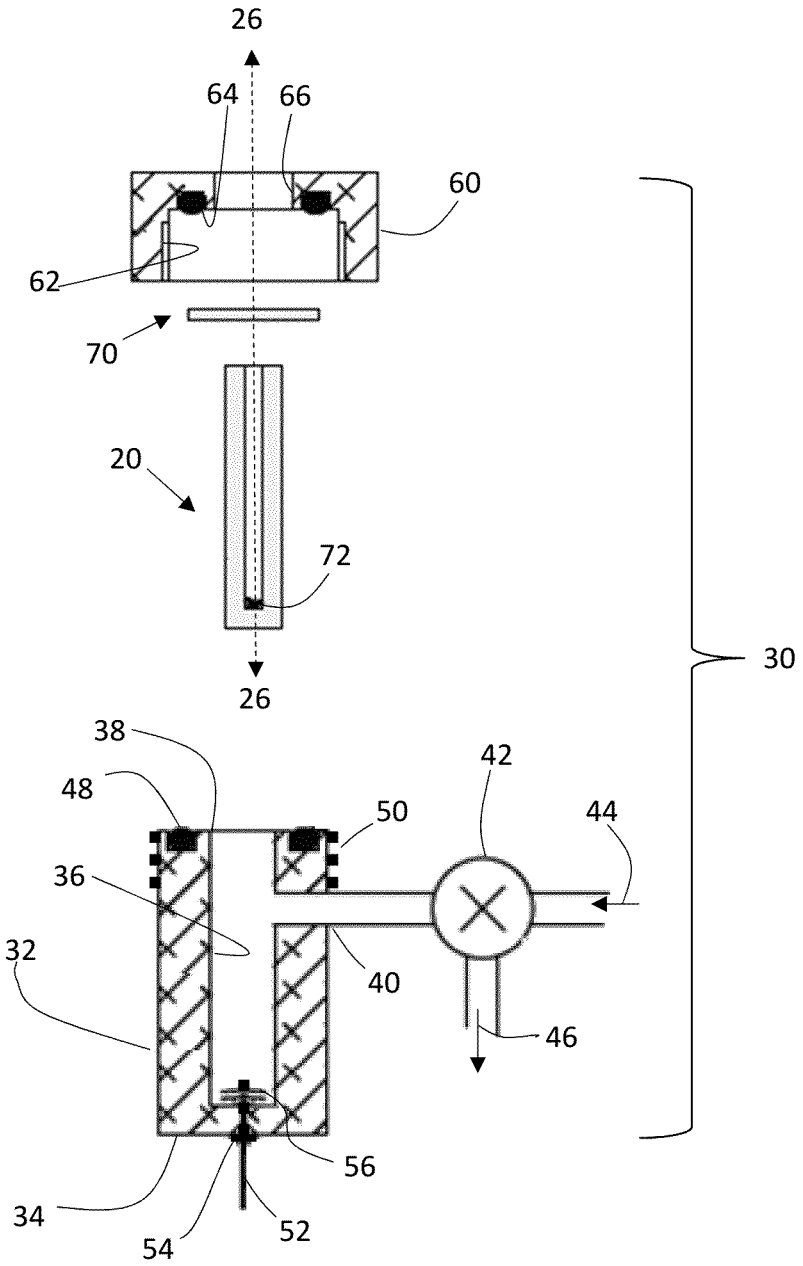
FIG. 2 shows the process of arranging the envelope blank into fixturing to allow processing of the envelope blank into a hermetically sealed envelope.

As shown in FIG. 2, the pressure chamber 30, and a polished and clean top end window 70, and the clean envelope blank 20 may be introduced into the atmosphere controlled glove box. The top end window 70 and envelope blank 20 may be arranged with the matching crystal axis 26 with the mating faces of the top end window and the axial end of the envelope blank both perpendicular to the axis 26. The envelope blank 20 may be loaded with halides, mercury, and/or any other light emission expedient materials 72 that are desired to be enclosed in the envelope.

Figure 3:
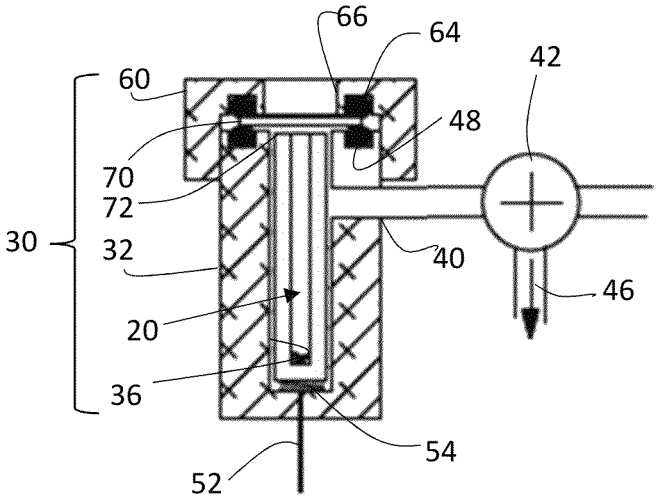
FIGS. 3-8 detail the process of finishing the envelope blank to form a hermetically sealed envelope using the fixturing of FIG. 2.

As shown in FIG. 3, the envelope blank 20 may be placed in the hollow interior 36 of the fixture body 32, and the top end window may be placed adjacent to the axial end of the envelope blank. The top end window 70 may rest on the fixture body axial end seals 48. As the seal cap 60 is secured onto the fixture body 32, the top end window 70 may be fixed in place between the seals 64 of the seal cap 60 and the axial end seals 48 of the fixture body. When the pressure chamber 30 is sealed, the plunger 54 may be moved downward in the fixture body hollow interior 36 to a first, lowered position. Under gravity, the envelope blank 20 may move vertically downward in the fixture body hollow interior 36 thereby allowing a gap 72 to form between the top end window 70 and the open axial end of the envelope blank 20. Once the gap 72 is formed between the top end window 70 and the open axial end of the envelope blank 20, the pressure chamber 30 may be evacuated through the three way valve 42 to the vacuum source 46. Drawing a vacuum in the pressure chamber 30 removes any impurities from the pressure chamber prior to hermetically sealing the envelope blank.

Figure 4:
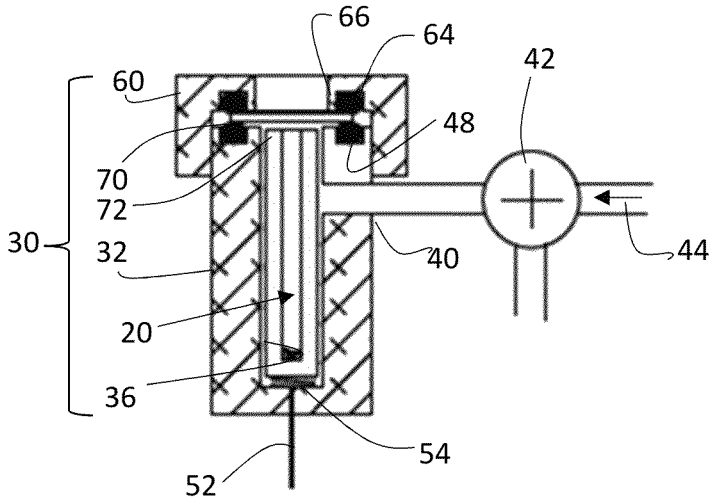

Once the vacuum is drawn in the pressure chamber 30 and any impurities are removed, the three-way valve 42 may be switched to direct fill gas from the gas source 44 into the pressure chamber 32 as shown in FIG. 4. The three-way valve 42 may be actuated to direct gas through the three-way valve and through the port 40 into the pressure chamber 30. The gas may flow into the hollow interior of the envelope blank 20. The gas may be neon, xenon, argon, or any other selected gas to create a desired emission of light energy. The plunger 52 is maintained in the first, lowered position during filling to maintain the gap between the axial end of the envelope blank and the top end window to allow the gas to flow into the interior of the envelope. In addition, or in the alternative, to drawing a vacuum and filling operation, the pressure chamber may be purged with the fill gas.

Figure 5:
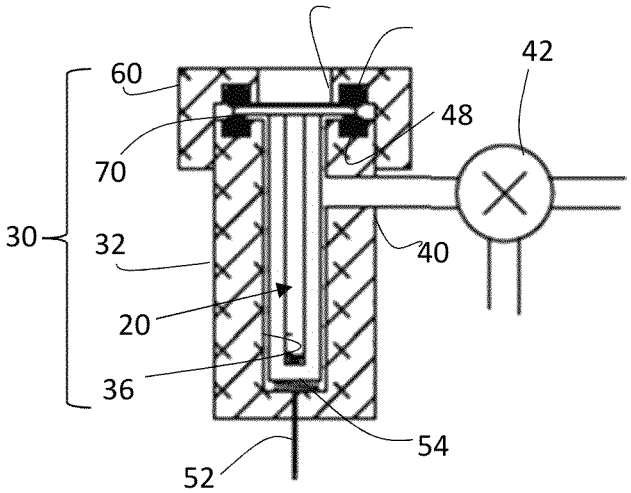

Once the envelope blank is filled with the gas, the plunger 52 may be moved to a raised, second position such that the coil spring biases 54 the envelope blank 20 against the top end window 70. The valve 42 may be closed, as shown in FIG. 5. The pressure chamber 30 may then be removed from the glove box prior to the commencement of the final sealing operations.

Figure 6:
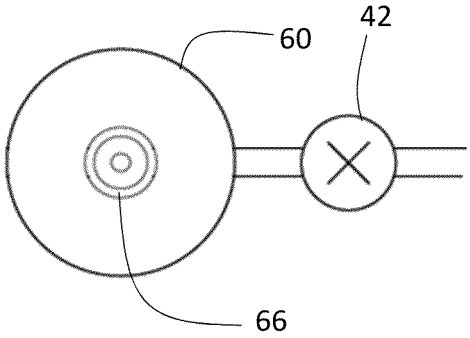
Figure 7:
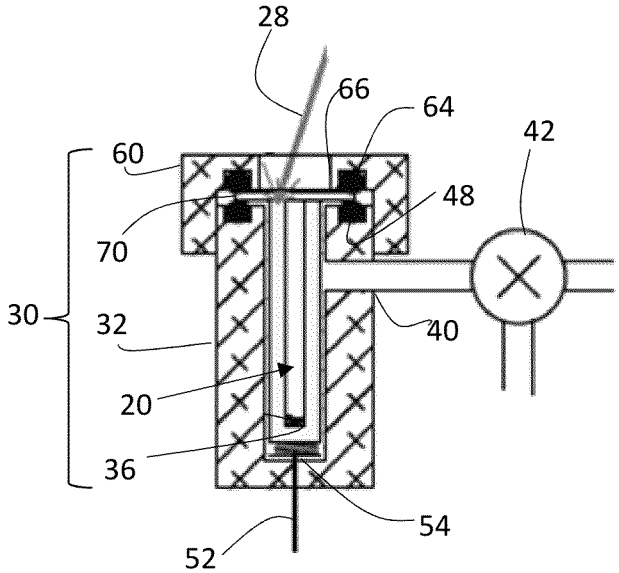

With the top end window 70 and axial end of the envelope blank 20 in mating contact, localized heating 28 with an ultra-short pulse laser system may commence to hermetically seal the envelope blank. The envelope blank 20 may be filled at close to room temperature or cooled lower than room temperature to protect the solids, such as, mercury and halides, which may be sealed into the envelope blank. FIG. 6 shows further detail of the top of the threaded compression seal cap 60. As described above, the seal cap 60 has an access opening 66 that has a diameter larger than the outer diameter of the envelope blank. The access opening 66 in the seal cap 60 accommodates the needed travel of the beam of the ultra-short pulse laser system laser so that the beam may be directed to the axial ends of the envelope blank to seal the top end window and with axial ends of the envelope blank 20 to form the completed hermetically sealed envelope. As shown in FIG. 7, the beam 28 may travel in a circular path corresponding to the axial end of the envelope blank 20. The mating surfaces of the envelope blank and the top end window may be fused together with the localized heating 28 to form a monolithic structure, hermetically sealing the envelope. Because of the localized (microscopic level) heating from the ultra-short pulse laser system to seal the envelope, the gas, and radiation emission expedients, disposed in the interior of the envelope are not degraded from excess heat, nor is the window or envelope damaged or cracked by excessive heat. A laser absorbing layer may be applied to the top end window 70 and/or the open axial end of the envelope blank 20 to improve the localized heating and overall sealing process.

Figure 8:
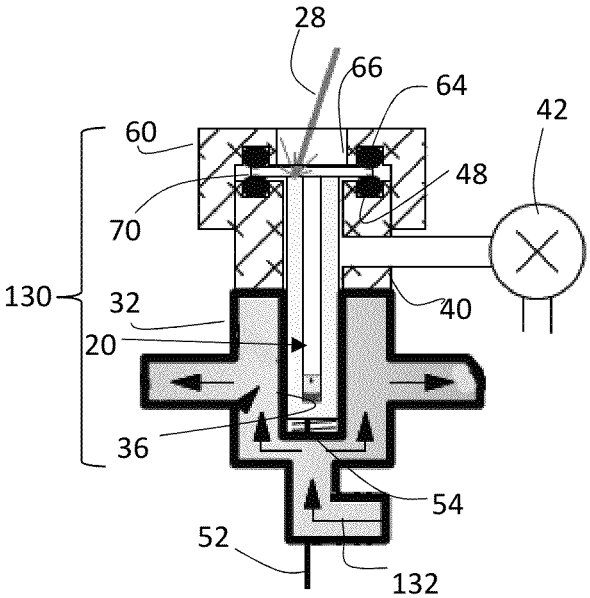
Figure 9:
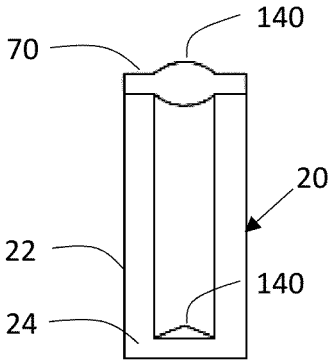
FIGS. 9-14 show exemplary envelopes with illustrative lenses that may be applied to the lamp envelope.
Figure 10:
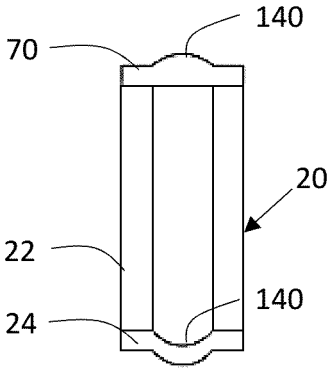
Figure 11:
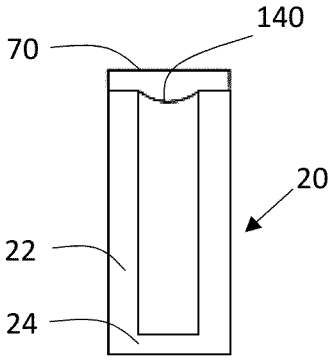
Figure 12:
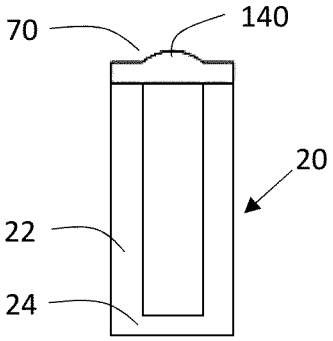

FIG. 8 shows an alternate embodiment of the pressure chamber 130 wherein the envelope blank is hermetically sealed by subjecting the pressure chamber to a cooling fluid 132 such as a cryogenic solution (i.e., liquid nitrogen). The cooling fluid allows the gas in the envelope blank to condense to a liquid, which creates a partial vacuum in the hollow interior of the envelope blank prior to sealing. This may improve laser sealing using the methods described above. For instance, if the gas pressure is in excess of one atmosphere (1 ATM), cooling fluid 132 may be directed into a jacket surrounding the fixture body 32 to cool the hollow interior of the fixture body and the envelope, and thereby turning the gas to a liquid and creating a partial vacuum in the envelope blank interior. Once the laser operations are complete, the hermetically sealed envelope may be removed from the pressure chamber for use.

FIGS. 9-14 provide examples of precision optics that may be applied to the envelope 20. Because the laser sealing operations do not heat the top and/or base end window(s) 24,70, precision lenses 140 may be formed on any surfaces of the top and base end window(s) 24,70 without distortion of the optics. The lenses 140 may be provided on one or both ends of the envelope blank 20. Using the methods described previously, the base end window 24 may have a lens formed thereon prior to laser sealing to the lamp tube to form the envelope blank 20. Thus, the envelope blank may have a lens 140 formed on its axial end adjacent the spring and plunger shown in the fixturing of FIGS. 2-8. As shown in FIGS. 9-14, the lenses 140 applied to the surfaces of the top and base end window(s) may be concave or convex, thereby providing the end window with a parabolic and/or mushroom shape, as may be desired by the application of the lamp envelope.

Figure 15:
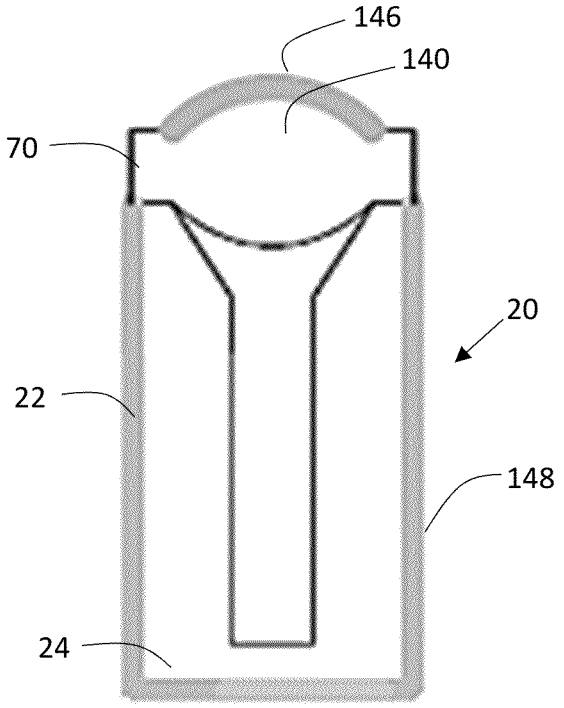
FIG. 15 is an exemplary envelope with a dielectric coating deposited on an axial end and outer surface of the envelope.

FIGS. 15 and 16 provide examples of envelopes 20 with dielectric coatings applied to lenses 140 and an exterior of the lamp envelope. The dielectric coatings may be deposited on the top and/or base end window(s) 24,70 of the envelope 20 and to the interior and/or exterior of the lamp tube 22 prior to laser sealing operations. Dielectric coatings may be arranged on the top and/or base end windows 24,70, and/or the lamp envelope exterior/interior to reflect and transmit specific, selected wavelengths of light from the envelope. This allows the lamp envelope to be configured for specific applications as desired, for instance, for UV lithography, ellipsometry, transmission of infrared radiation, or transmission of visible light. Because the laser sealing operations do not raise the temperature of the top and/or base end window(s) or the lamp envelope, the laser sealing operations do not detrimentally degrade the dielectric coating applied to the top and/or base end window(s), and/or exterior surfaces of the lamp envelope. Lenses and/or lamp envelopes with dielectric coatings allow the selection of wavelengths to be reflected, filtered, and transmitted depending upon a particular application. Certain wavelengths that the lamp does not need to transmit may be reflected back into the lamp envelope thereby increasing lamp efficiency and power output by further heating of the plasma. Selected areas on the exterior of the lamp envelope may be coated with the dielectric to further enhance the performance of the lamp. Because the dielectric coatings are nonconductive, the coating will not be affected by or impact the magnetic or electric fields used to power the lamp. The coatings may be deposited on any surface of the envelope blank that is not used for sealing. The sealing surfaces of the blank envelope and the window may be masked prior to coating with the dielectric to keep the areas to be sealed free of any coating. This allows a coated end window and envelope blank to be sealed together without contaminating the sealing surfaces with the coating and thus reducing sealing reliability.

FIG. 15 shows a lamp envelop 20 with a dielectric coating 146 comprising a broad band UV transmissive coating that transmits only desired wavelengths of ultraviolet light disposed over the lens 140 formed on the top end window 70. The lens 140 of the top end window of the envelope focuses the UV emission to the target. Desired ultraviolet radiation is focused out of the lamp envelope by the lens shape. The exterior of the lamp envelop 20 is coated with a broad band UV reflector coating 148 that reflects radiation back into the lamp. The other wavelengths are reflected back into the lamp to further heat the plasma and make the lamp more efficient. FIG. 16 provides another example of a lamp envelope configuration where the envelope 20 is a generally parabolic tube. The dielectric coating 150 deposited on the top end window 70 allows emission of white light from the lamp. Infrared and ultraviolet emissions are reflected back into the lamp to further heat the plasma of the lamp and make the lamp more efficient. The dielectric coating 152 deposited on the tube exterior comprises a broad band reflector that reflects all radiation back into the lamp. The visible or white light is focused out of the lamp by the parabolic shape of the envelope and the dielectric coating 152 on the envelope.

The methods described herein may be used to fabricate lamp envelopes from other materials in addition to sapphire. Lamps envelopes may be formed from diamond, crystalline quartz, ruby, magnesium fluoride, spinel, silicon, YAG, and salts. Because the methods do not heat the lamp envelope, the methods described herein may be used to fabricate lamps made of more traditional glass materials, such as fused quartz, borosilicate, alumino silicate, etc., where a precision glass lens or coated glass lens may be sealed onto an envelope blank to form the sealed lamp envelope. An additional advantage of the methods disclosed herein involves pure material to material sealing with no foreign sealing materials involved. For instance, no brazes, frits, etc. are used. This reduces weaknesses and contaminants that would otherwise come from foreign sealing material.

In view of the foregoing, it will be seen that the several advantages of the invention are achieved and attained. The embodiments were chosen and described in order to best explain the principles of the invention and its practical application to thereby enable others skilled in the art to best utilize the invention in various embodiments and with various modifications as are suited to the particular use contemplated. As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A method comprising:

accessing an envelope blank and a window;

depositing a gas in an interior of the envelope blank;

arranging a window on an open end of the envelope blank;

using an ultra-short pulse laser system to locally heat the axial end of the envelope blank and the window to seal the window on the envelope blank without degrading the gas deposited in an interior of the envelope or the envelop material.

2. The method of claim 1, wherein the step of using the ultra-short pulse laser system comprises using a femtosecond laser.

3. The method of claim 1, wherein the step of using the ultra-short pulse laser system comprises using a picosecond laser.

4. The method of claim 1, wherein the step of using the ultra-short pulse laser system comprises using an attosecond laser.

5. The method of claim 1, further comprising depositing light generating expedient material in the envelope interior prior to filling the envelope with the gas.

6. The method of claim 1, wherein the step of accessing the envelope blank and window includes accessing an envelope blank and window comprising sapphire.

7. The method of claim 1, wherein the step of accessing the envelope blank and window includes accessing an envelope blank and window comprising quartz.

8. The method of claim 1, wherein the step of accessing the envelope blank and window includes accessing an envelope blank and window comprising Magnesium Fluoride ($MgF_2$).

9. The method of claim 1, further comprising forming the envelope blank with a lens.

10. The method of claim 1, further comprising forming the window with a lens.

11. The method of claim 1, further comprising depositing a dielectric coating on the window.

12. The method of claim 1, further comprising forming an axial end of the envelope blank with a geometry that cooperates with a geometry formed on the window to form a lens.

13. The method of claim 1, wherein the step of depositing gas in the interior of the envelope includes cooling the envelope prior to sealing the envelope.

14. The method of claim 1, further comprising coating the window with a dielectric coating selected to allow emission of radiation from the lamp in a desired wavelength while reflecting back into the lamp wavelengths not to be emitted thereby making the lamp more efficient.

15. The method of claim 1, further comprising coating a surface of the envelope with a dielectric coating selected to allow emission of radiation from the lamp in a desired wavelength while reflecting back into the lamp wavelengths not to be emitted thereby making the lamp more efficient.

16. The method of claim 1, further comprising forming at least one of the window and lamp tube with a laser absorbing layer.

17. A method of forming a lamp bulb comprising:

accessing a lamp tube;

arranging an end window to cover over an axial end of the lamp tube;

micro-heating the end window and lamp tube axial end with a ultra-short pulse laser system to seal the base end window against the axial end of the lamp tube.

18. The method of claim 17, further comprising forming a lens on the base end window.

19. The method of claim 17, further comprising depositing a dielectric coating on the base end window.

20. The method of claim 17, further comprising masking the base end window and axial end of the lamp tube prior to sealing to protect the sealing surfaces.

21. The method of claim 17, wherein the step of arranging the end window comprising arranging the end wind on an axial end of the lamp tube to hermitically seal the lamp tube.

22. The method of claim 17, further comprising forming at least one of the window and lamp tube with a laser absorbing layer.

23. The method of claim 17, further comprising coating the window with a dielectric coating selected to allow emission of radiation from the lamp bulb in a desired wavelength while reflecting back into the lamp bulb wavelengths not to be emitted thereby making the lamp bulb more efficient.

24. The method of claim 17, further comprising coating a surface of the lamp tube with a dielectric coating selected to allow emission of radiation from the lamp bulb in a desired wavelength while reflecting back into the lamp bulb wavelengths not to be emitted thereby making the lamp bulb more efficient.

* * * * *